United States Patent [19]

Higuchi et al.

[11] Patent Number: 4,842,958

[45] Date of Patent: Jun. 27, 1989

[54] CHROMATE SURFACE TREATED STEEL SHEET

[75] Inventors: Seijun Higuchi; Tomonari Ohga; Toshinori Katayama; Fumio Yamamoto, all of Kitakyushu, Japan

[73] Assignee: Nippon Steel Corporation, Tokyo, Japan

[21] Appl. No.: 38,349

[22] Filed: Apr. 14, 1987

[51] Int. Cl.[4] ..... B32B 15/04

[52] U.S. Cl. ..... 428/629; 428/632; 428/667; 428/685

[58] Field of Search ..... 428/629, 632, 666, 667, 428/684, 685

[56] References Cited

U.S. PATENT DOCUMENTS

| | | | |
|---|---|---|---|
| 3,826,628 | 7/1974 | Addinall et al. | 428/629 |
| 3,827,866 | 8/1974 | Uchida et al. | 428/667 |
| 4,296,182 | 10/1981 | Matsubayashi et al. | 428/629 |
| 4,455,355 | 6/1984 | Inui et al. | 428/629 |
| 4,542,077 | 9/1985 | Ogata et al. | 428/629 |

FOREIGN PATENT DOCUMENTS

| | | | |
|---|---|---|---|
| 83792 | 5/1984 | Japan | 428/667 |

*Primary Examiner*—L. Dewayne Rutledge
*Assistant Examiner*—George Wyszomierski
*Attorney, Agent, or Firm*—Wenderoth, Lind & Ponack

[57] ABSTRACT

A chromate surface treated steel sheet having very excellent paintability, corrosion resistance, and workability, more specifically surface treated steel sheets for paint coating, having very excellent properties, specifically with respect to corrosion resistance after paint coating, paint adhesion in services long after the paint coating (so-called secondary paint adhesion), corrosion resistance of paint coating defect portions, and resistance to secondary work cracking. The steel sheet contains not more than 0.15% carbon, 0.005 to 0.10% acid soluble aluminium, 0.5 to 20% chromium with the balance being iron and unavoidable impurities, and the chromate coating applied on the steel substrate comprises a metallic chromium layer in an amount ranging from 1 to 300 mg/m$^2$, and a hydrated chromium oxide layer in an amount ranging from 5 to 50 mg/m$^2$ in term of the metallic chromium contained therein.

8 Claims, 3 Drawing Sheets

CHROMATE SURFACE TREATED STEEL SHEET

BACKGROUND OF THE INVENTION

1. Field of the Invention

The present invention relates to a chromate surface treated steel sheet having very excellent paintability, corrosion resistance, and workability, more specifically surface treated steel sheets for paint coating, having very excellent properties, specifically with respect to corrosion resistance after paint coating, paint adhesion in services long after the paint coating (so-called secondary paint adhesion), corrosion resistance of paint coating defect portions, and resistance to secondary work cracking.

2. Description of the Related Arts

Conventionally, as for steel sheets which are used in the paint coated form for various containers, a surface treated steel sheet prepared by applying a dual layer coating consisting of a metallic chromium layer and a chromium oxide layer mainly composed of hydrated oxide on the surface of cold rolled steel sheet (known as TFS-CT sheet) as disclosed in Japanese Laid-Open Patent Application No. Sho 54-95941 has been widely used and has been found to give satisfactory results with respect to paint adhesion, corrosion resistance after paint coating as well as economical advantages.

The TFS-CT treated steel sheets which are prepared by the TFS-CT treatment of the steel substrate of ordinary steel composition have been widely used as steel materials for many applications, including welded cans notably for their excellent paintability, can lids or crowns for their good paint adhesion after press working and good corrosion resistance after paint coating, and paint coating steel substrates as building materials.

In recent years, increasing demands have been made for surface-treated steel sheets having various improved properties, such as improved performances to meet with the expansion and diversification of the application fields of steel sheet materials, excellent appearance quality to meet with the high quality preference tendency of consumers, and good resistance against rust formation during storage.

For example, in order to meet with the increased demand for deformed cans, such as necked-in cans, substantial improvements in corrosion resistance with respect to after-paint coating in severely worked portions of articles, improvements in paint adhesion after a long period of storage and so on have been sought for.

Also in connection with steel sheet materials for can lids, the easiness in opening of the lids have been demanded more than conventionally, and in order to meet with this demand, it is necessary to improve the corrosion resistance after paint coating after working as the thickness of the can lid material sheet is made thinner, or the score residual of score worked portion is made thinner.

Further in applications, such as can bottom lids where clear lacquer coating is applied prior to use, a beautiful whitish appearance with metallic luster is more demanded than the after-paint-coating corrosion resistance and the paint adhesion. In the field of crowns, various properties, particularly resistance against the red rust formation initiated at cut edges during storage are required to be improved in connection with sheet materials for crowns and resistance against the red rust formation caused during storage of severely worked materials for can bodies and can lids is required to be improved.

For applications other than the can containers, such as house building, particularly roofs and walls, and automobiles, demands have been increasing for steel sheet substrates for paint coating, having a long term corrosion resistance and excellent paintability as well as good press formability.

Various extensive studies and investigations have been made by the present inventors to meet with the above demands in various fields of applications, and found that all chromate treated steel sheets, particularly TFS-CT treated steel sheets, which have been widely used as paint coating substrates, are prepared from Al-killed steel containing no corrosion resistance improving element and these steel sheets have problems that they show a lower electrode potential than the paint coating applied thereon so that when damaged through the paint coating to the substrate during the working after the paint coating, rust is formed at these damaged portions to dissolve the iron, causing deterioration of the after-paint-coating corrosion resistance and the paint adhesion.

Further, at these coating damaged portions or coating defective portions, pitting corrosion is caused to deteriorate the corrosion resistance.

Still further, it has been found that when paint coated articles are exposed to a corrosive media for a long period, the edge surfaces will suffer red rust formation because the edge surfaces have a lower electrode potential than the paint coating to dissolve the iron therefrom.

Meanwhile, the demand for improved appearance of surface treated steel sheets has been arising from the fact that the steel substrates are rendered to be blackish on their surfaces due to the etching effect of the chromate bath into which the substrates are immersed to give them a chromate coating, such as TFS-CT.

For the purpose of improving the workability, steel substrated containing less carbon have been conventionally used, but these substrates are very susceptible to the secondary work cracking due to the embrittled grain boundaries caused by adverse effects of unavoidable impurities, such as P and S in the steel.

SUMMARY OF THE INVENTION

Therefore the object of the present invention is to provide a high-performance steel substrate for paint coating which can overcome the above difficulties and problems mentioned above, having improved after-coating corrosion resistance, improved paint coating adhesion for a long period of service, less susceptible to pitting corrosion at paint coating defective portions, capable of suppressing red rust formation at edge surfaces, and having excellent workability and appearance quality.

The chromate surface treated steel sheet according to the present invention comprises a chromium-containing steel sheet containing not more than 0.15% carbon, 0.005 to 0.10% acid soluble aluminium, 0.5 to 20% chromium, with the balance being iron and unavoidable impurities, and a chromate coating applied on the steel sheet, which chromate coating comprises a metallic chromium layer in an amount ranging from 1 to 300 $mg/m^2$, and a hydrated chromium oxide layer in an amount ranging from 5 to 50 $mg/m^2$ in term of the metallic chromium contained therein.

The steel sheet may contain at least one of Ti, Nb, Zr, and V, in an amount ranging from 0.03 to 0.5%; nickel in an amount ranging from 0.1 to 10%; and/or boron in an amount not more than 0.0030%.

DETAILED DESCRIPTION OF THE INVENTION

The chromium-containing steel substrates for paint coating according to the present invention may be prepared by continuous casting or ingot-casting from a molten steel prepared in a melting furnace such as a converter and an electric furnace into slabs or ingots, and hot rolling and cold rolling of the slabs and further annealing of the cold rolled sheets.

Reasons for limiting the amounts of individual elements in the present invention will be explained below.

Carbon is an essential element for economically affording the required strength to the steel, and usually added in an amount ranging from more than 0.02% to 0.15% for the purpose. With carbon contents not more than 0.02%, no substantial improvement of the strength or hardness, which is a main object of the present invention, can be expected even when at least one of the main addition elements: Cr, Ti, Nb, Zr, and V, is co-added. Therefore in the present invention the carbon content should be more than 0.02%, preferably not less than 0.05%. On the other hand, if the carbon content exceeds 0.15%, the improvement effect of strength or hardness will saturate, and the precipitates of carbides formed with the chromium, titanium and the like in the steel will increase and these precipitates grow coarse to embrittle the steel, thus inducing occurrence of cracks during press forming. Therefore, the carbon content should be not more than 0.15%, preferably not more than 0.10%. From the view points of workability and corrosion resistance, the increased carbon content tends to precipitate chromium carbide and deteriorate the workability and corrosion resistance. In this connection, therefore, the carbon content should be not more than 0.02%, preferably not more than 0.005%.

Aluminium, when present in a small amount less than 0.005% in the term of acid soluble aluminium (Sol Al) remaining in the steel, can hardly prevent the bubbling caused by oxygen-containing gas so that the surface defect occurrence is markedly increased, causing the deterioration of corrosion resistance of the steel. On the other hand, if the Sol Al is present in an amount exceeding 0.1%, it produces aluminium oxides scattered on the surface of the steel, which function as causes for deterioration of corrosion resistance of the steel, and in the case of TFS-CT surface treated steel sheets, these scattered oxides cause non-uniformities of the treatment, such as local non-coating and pinholes. Therefore, the content of Sol Al should be in the range from 0.005 to 0.10%, preferably from 0.01 to 0.08% for assuring consistent qualities of the steel.

The addition of chromium contributes to bring the electric potential of the steel sheet exposed to the corrosive media to the noble side, closer to the electric potential of the chromate treatment coating, namely the metallic chromium layer and the chromium oxide layer mainly composed of hydrated chromium oxide. At the same time, the chromium addition improves the corrosion resistance of the steel itself, as well as the properties such as the after-coating corrosion resistance and paintability of the chromate treated steel substrates, such as TFS-CT treated substrates for paint coating. In short words, the addition of chromium contributes to bring the electric potential of the steel substrate closer to that of the chromate treatment layer, thus reducing the galvanic corrosion current between the substrate and the coating layer. And at the same time the addition of chromium can improve the corrosion resistance of the steel substrate itself and reduce the self-corrosion of the substrate itself exposed to corrosive aqueous solutions.

With the addition of chromium, the steel substrates according to the present invention has the following advantages when the substrates after paint coating are exposed to the corrosive media. Thus when the paint coated steel sheet having coating defects or scratches penetrating through the coating to the substrate or coating cracks caused during the working is exposed to the corrosive media, the under-coating corrosion developing from the substrate where the coating is scratched is remarkable if chromium is present only as impurity in the steel substrate. For example, the substrate has a baser electric potential than the chromate treatment layer in the corrosive aqueous solution and the galvanic corrosion current therebetween is large so that the substrate is preferentially dissolved, or corroded. The result is that the corrosion of the substrate penetrates deeply in the direction of the depth of the coating defects to cause the danger of pitting corrosion, and also the corrosion of the substrate expands not only in the depth direction of the defect, but also in the lateral direction under the coating to cause peeling off of the coating over the wider range around the defect portion.

Whereas when the substrate contain chromium as defined in the present invention, the improvement of the corrosion resistance of the substrate itself and the approach of the electric potential to that of the chromate treatment layer can effectively suppress the corrosion developing from the substrate even when the substrate having coating scratches or cracks penetrating to the substrate is exposed to the corrosive aqueous solution, thus preventing the pitting corrosion and the under-coating corrosion to improve the paint coating adhesion. For the above purpose, chromium is added to the steel in an amount ranging from 0.5 to 20%, preferably from 3 to 18%. With the chromium content less than 0.5%, the desired improvements of the after-paint-coating corrosion resistance and the paint coating quality cannot be obtained. On the other hand, if the chromium content exceeds 20%, the improvement of the corrosion resistance of the steel substrate itself saturates and rather it tends to harden the steel, hence deteriorating the workability of the steel, and further produces problems such that the chromate treatment intended to improve the paint coatability etc. of the substrate cannot be uniformly applied.

Additionally, from the point of press formability, the steel composition containing not more than 11% chromium in which the transformation is effected between the gamma phase and the alpha phase is particularly preferable, because the coarsening of the grains during the steel sheet manufacturing is suppressed by the transformation, and the surface roughening phenomenon, known as ridging of the steel sheet which is often caused when the sheet is subjected to severe press forming is also suppressed.

Further, from the considerations to assure the metallic brightness of the surface appearance, to prevent the red rust formation developing from the sheet edges, and to prevent the corrosion due to etching effects during the chromate treatment, the chromium content in the steel should be not less than 3%, preferably not less than 5%.

The improvements of various properties of the steel substrate as mentioned above can be more enhanced when nickel is added to the chromium-containing steel as mentioned above. In particular, the nickel addition improves the corrosion resistance of the paint-coated steel sheet at the portions where the coating is defective or is damaged by the working to the substrate.

Thus the nickel addition renders the electric potential of the substrate baser in corrosive media, thus reducing the galvanic corrosing current between the substrate and the chromate treatment coating, and improving the corrosion resistance of the substrate itself. In this way, the corrosion due to the preferential dissolution of the substrate exposed to the corrosive media through the defective coating can be remarkably alleviated. Therefore, the pitting corrosion penetrating in the depth direction of the exposed substrate is reduced, hence the effective service life of the coated article against the corrosion can be further elongated, the corrosion of the exposed substrate developing in the lateral direction under the paint coating can be reduced, and the area of peeling off of the coating from the defective portion can also be considerably reduced. In this way, the improvement effects on the corrosion resistance, paint adhesion, and after-coating corrosion resistance can be further enhanced by the addition of nickel.

Still further, the steel sheet containing both chromium and nickel is superior to the steel sheet containing only chromium with respect of the metallic brightness of the surface appearance, because even after the chromate treatment, the former steel substrate maintains its own brightness and has good corrosion resistance against the etching action during the chromate treatment. In this way, a surface appearance of high beauty having metallic brightness can be maintained after the paint coating.

For the above purposes, nickel is added to the chromium containing steel in an amount ranging from 0.1 to 10%. With nickel contents less than 0.1%, the improvement of corrosion resistance of the chromium-containing steel can not be substantially enhanced, and no definite improvements on the paint coatability and the after-coating corrosion resistance can be obtained. Therefore, the nickel content should be not less than 0.1%, preferably not less than 0.5%. On the other hand, with nickel contents more than 10%, the improvement effect on the corrosion resistance of the chromium-containing steel saturates, and problems are caused, such that the pretreatment for assuring the adhesion of the metallic chromium coating during the chromate treatment is very difficult to perform. Therefore the nickel content should be added in amount not more than 10%, preferably not more than 8%.

According to a modification of the present invention, at least one of Ti, Nb, Zr, and V may be added to the above basic steel composition in an amount ranging from 0.03 to 0.50% to combine with carbon in the steel so as to more effectively utilize the function of the chromium content in the steel, thereby further enhancing the press formability and corrosion resistance.

With the contents less than 0.03% of at least one of the above elements, for example Ti, the precipitation of chromium carbides can hardly be prevented, hence no substantial improvement of the press formability and corrosion resistance can be obtained. On the other hand, if the content exceeds 0.50%, their effects saturate and not economical, and they harden the steel through their precipitation, tending to deteriorate the press formability.

A preferable range of the contents of the these elements is from 0.075 to 0.20%. Moreover, when various properties, such as workability and corrosion resistance, of the chromium-containing steel are to be improved, molybdenum may be added in an amount (about 1%) as usually added in stainless steels.

According to a further modification of the present invention, boron is added to the above steel composition in an amount not more than 0.003% for the purpose of preventing the secondary work cracking of the steel which is caused when the steel is subjected to severe forming and given impacts at low temperatures, as confronted during actual service in the cold regions. The secondary work cracking may be attributed to the facts that the carbon content is limited to a very small amount in order to improve the press formability as mentioned before, and this small amount of carbon is fixed by the addition elements such as Cr, Ti, and Nb so that the unavoidable impurities such as phosphorus and sulfur are allowed to precipitate at the grain boundaries to embrittle the grain boundaries.

Boron, when added in an appropriate amount, suppresses the precipitation of the impurities such as P and S through its own precipitation at the grain boundaries in preference to the impurities, hence preventing the secondary work cracking. For this purpose, boron is added in an amount not more than 0.003%, preferably not more than 0.001%.

When boron is added in an amount more than 0.003%, the steel hardens excessively, resulting in deterioration of the press formability. The effect of preventing the secondary work cracking can be obtained with a small boron content as small as 0.00010%.

Additionally, the boron addition is also effective to prevent the growth and coarsening of grains at heat affected zones as often seen when the steel is subjected to high temperatures treatments, such as welding and soldering.

The present inventors have found that the steel sheet having the chemical composition as described above cannot provide satisfactory after-coating corrosion resistance and satisfactory paint adhesion after long period of exposure to corrosion aqueous solutions for example, as illustrated in FIG. 2, and found that it is necessary to apply a chromate treatment coating composed of metallic chromium layer and a hydrated chromium oxide layer by a cathodic treatment in an aqueous solution containing $Cr^{+6}$ ions, $So_4^{-2}$ ions, $Fe^-$ ions etc.

Thus, the chromium-containing steel sheet according to the present invention, despite of its inherent improved corrosion resistance, cannot provide a satisfactory adhesion strength between the paint coating and the steel surface due to a thin, stabilized oxide film formed on the steel surface when the paint coating is applied directly on the steel surface, and when the steel sheet directly paint coated is exposed to a corrosive aqueous solution for a long period of time, the corrosive solution permeating through the paint coating or through defective paint coating attacks the steel surface; hence a great tendency of peeling off of the paint coating. Thus the steel sheet directly paint coated cannot provide desired paint adhesion, after-coating corrosion resistance, and secondary paint adhesion etc.

Figure 1:
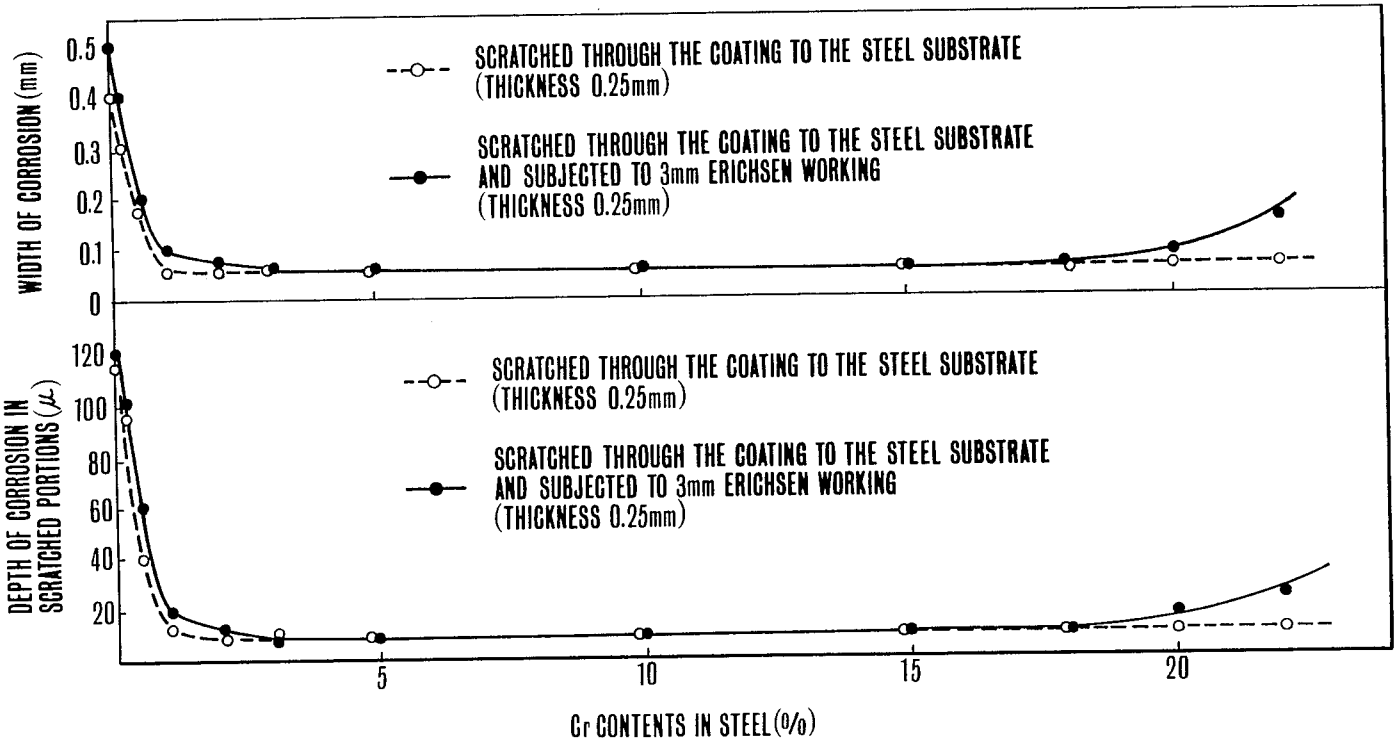
FIG. 1 shows the effects of chromium contents in the steel on the paint adhesion.
Figure 2:
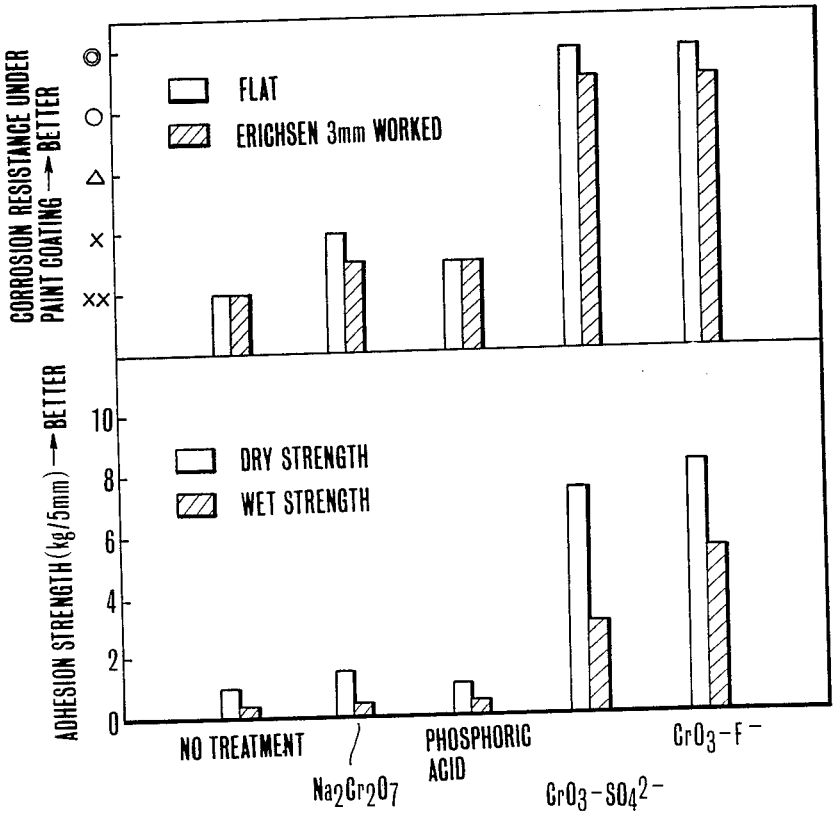
FIG. 2 shows the paint adhesion and the after-painting corrosion resistance of various coating layers.

The present inventors have conducted extensive studies and experiments for improving the paint adhesion, coating qualities including paint adhesion and after-coating corrosion resistance of the steels sheets of the chemical composition as defined in the present invention, and found that, as illustrated in FIG. 2, the paint coating qualities can be markedly enhanced by applying a chromate treatment coating composed of a metallic chromium layer and an chromium oxide layer mainly composed of hydrate oxides on the steel surface.

In FIG. 2 the relation between the paint coating qualities and various treating conditions as mentioned below is shown, and the results are evaluated by the criteria set forth below.

1. Treating Conditions (1) $Na_2Cr_2O_7$: 30 g/l $Na_2Cr_2O_7$ (pH4.5), 70° C., 8A/dm$^2$- 3.8 sec., cathodic treatment.

(2) Phosphoric Acid: 25 g/l phosphoric acid, 50° C., 10A/dm$^2$- 3 sec., cathodic treatment.

(3) $CrO_3$-$SO_4^{2-}$: $CrO_3$100 g/l, $SO_4^{2-}$ lg/l, 50° C., 60A/dm$^2$- 0.5 sec., cathodic treatment.

(4) $CrO_3-F^-$: $CrO_3$ 85 g/l, $SO_4^2-0.07$ g/l, 40° C. $F^-$1.8 g/l, 60A/dm$^2$- 0.5 sec., cathodic treatment.

2. Evaluation Criteria (1) Under-Coating Corrosion Resistance:

Test Piece: 50±5 mg/dm$^2$ of epoxyphenol paint is applied on the steel substrate and scratch is given through the coating to the surface of the substrate.

Test Condition: Immersed in a solution of 1.5% citric acid+1.5% salt, at 55° C. for 96 hours. After the immersion, the tape is stripped off.

Evaluation: In the term of area of paint peeling off.

⊙. . . Not more than 5%

○. . . Not more than 10%

Δ . . . Not more than 20%

X . . . Not more than 40%

XX . . . More than 40% to total peeling off (2) Adhesion Strength:

Test Piece: Two test pieces were prepared by applying epoxyphenol paint thereon and bonding them with nylon adhesive inserted therebetween under pressure.

Test Condition: The test pieces were stretched by a tensile testing machine in the form of T to measure the strength.

Dry strength: Strength obtained as bonded.

Wet strength: Strength obtained when 0.5% urea is added between the pieces.

As understood from the results shown in the cases of ordinary phosphoric acid treatments, chromate treatments and the like, which have been conventionally practised as a means for improving the paint coating quality of the steel substrates, it is difficult to form a uniform treatment film on the substrate, thus failing to produce the improvements on the coating qualities as desired and obtained by the present invention.

According to the present invention, the chromate treatment coating composed of a metallic chromium layer and a chromium oxide layer composed mainly of hydrated oxides is obtained by a cathodic treatment using an aqueous solution containing $Cr^{+6}$ ions and an aqueous solution containing $SO_4^{-2}$ ions, $F^-$ or their mixture. Therefore, in the chromate treatments, even when the stable oxide film has not been fully removed from the substrate surface by pretreatments such as degreasing and acid pickling, the remaining oxide film can be removed through reduction reaction by the cathodic electrolyzing treatment in the chromate bath containing anions. In this way, the chromate treatment coating composed of the metallic chromium layer and the chromium oxide layer can be uniformly formed on the substrate, and the adhesion between the chromium oxide layer and the paint coating layer is so strong that even when the paint coated substrate is immersed for a long period of time in a corrosive aqueous solution, the solution penetrating through the paint coating layer or through the cracks of the paint coating can be effectively prevented by the chromate film from attacking the substrate surface, thus preventing the formation of corrosion product on the substrate surface, and hence markedly improving the paint adhesion.

Figure 3A:
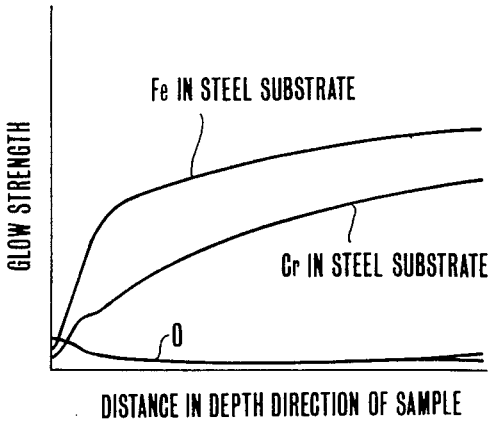
FIG. 3 shows analysis results of the cross sections of the substrates (FIG. 3(*a*)) and chromate treated substrates (FIG. 3(*b*)) by the glow discharge spectroscopy.
Figure 3B:
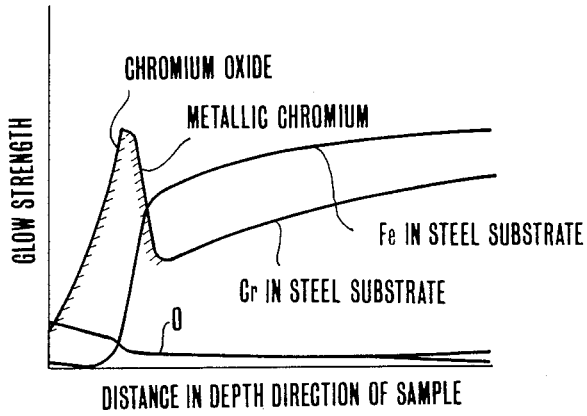

Also as understood from FIG. 3(*b*) showing one illustration of the analysis of Cr, Fe, Ni, and O in the cross section of the chromate treated ($CrO_3$-F) substrate (Cr 16%) by the discharge spectroscopy (GDS=G.10W) in comparison with the similar analysis of the substrate without the chromate treatment shown in FIG. 3(*a*), the chromium content in the surface of the chromium-containing steel sheet is lowered by the dechromination phenomenon if the chromate treatment is not applied. This leads to deterioration of the corrosion resistance. On the other hand if the substrate is applied with the chromate treatment coating, the chromium content in the surface portion can be maintained at a high level, hence markedly improving the corrosion resistance after the paint coating.

In order to obtain the results or effects desired in the present invention as mentioned above, it is necessary to apply the chromate treatment coating composed of the metallic chromium layer of 1 to 300 mg/m$^2$ of metallic chromium on one side of the substrate and the chromium oxide layer mainly composed of hydrated chromium oxide in a range from 5 to 50 mg/m$^2$. With the metallic chromium layer less than 1 mg/m$^2$, no substantial improvement of the coating quality can be obtained. On the other hand, if the metallic chromium layer exceeds 300 mg/m$^2$ this layer will easily crack during the mechanical working, and once cracked, the cracks induce progressive cracking through the paint coating layer, thus deteriorating the coating quality. Therefore, the metallic chromium layer should be in the range from 1 to 300 mg/m$^2$, preferably from 5 to 60 mg/m$^2$.

Regarding the chromium oxide layer, less than 5 mg/m$^2$ of the chromium oxide layer will not give the desired uniform coating layer normally afforded by the chromium oxide layer, thus failing to produce the desired improvement of the coating quality, particularly the paint coating adhesion. On the other hand, when the chromium layer exceeds 50 mg/m$^2$, the improvement effect on the coating quality will saturate, and rather problems are caused in the surface appearance which is also of most concern in the present invention. With more than 50 mg/m$^2$ of the chromium oxide layer, the surface appearance will be tinted with yellowish color, or blackish color.

Therefore, the chromium oxide layer should be in the range from 5 to 50 mg/m$^2$, preferably from 7.5 to 20 mg/m$^2$.

As mentioned hereinbefore, the steel substrates for paint coating as defined in the present invention are often used in applications other than the containers, such as rust-proof sheet for automobiles and the like where they are subjected to press forming. For these applications, in order to prevent the biting by the dies, it is desirable to maintain the metallic chromium layer in a range from 5 to 25 mg/m$^2$, and to maintain the chromium oxide layer composed mainly of hydrated chromium oxide in a range from 7.5 to 15 mg/m$^2$, with the total amount of the both layers being in a range from 12.5 to 35 mg/m$^2$.

The formation of the chromate treatment coating on the chromium-containing steel substrate according to the present invention may be performed by the following method, for example.

Prior to the chromate treatment, the steel substrate is subjected to degreasing and acid-pickling. The degreasing is not specifically limited and may be done by any conventional methods, such as an immersion method using sodium silicate, caustic soda washing liquid etc., a spraying method using the same, an electrolytic degreasing method and their combinations.

Then after water-washing, the surface cleaning and surface activation are performed normally by acid-pickling, but for obtaining a uniform chromate film and better film adhesion, an cathodic electrolytic treatment is preferable. Thus, in order to obtain an chromate treated substrate having excellent surface appearance with high brightness, a cathodic treatment in a $H_2SO_4$ (0.5 to 10%) bath is most preferable.

Whereas during an anode treatment, a passivated film is formed on the steel surface by the treatment in the sulfuric acid bath, which impares the uniformity of the chromate film and the film adhesion. Also the an immersion type of acid-pickling is disadvantageous because of difficulty in removing the oxide film, thus inferior in the resultant quality of chromate film.

On the other hand, in the cathodic electrolytic treatment, the oxide film formed on the substrate surface is reduced and hence activated, and this surface activation is advantageous for obtaining a satisfactory surface appearance and an excellent quality and uniformity of the chromate film. For these purposes, the cathodic treatment is preferably performed under the following conditions.

Current density: 1 to 30A/dm$^2$, preferably 3 to 10A/dm$^2$.

Bath temperature: Room temperature to 70° C.

Treating time: 0.1 to 5 seconds.

The above treatment conditions are advantageous particularly for assuring a uniform chromate film and film adhesion.

For assuring the same, a short-time pretreatment acid-pickling in an aqueous solution containing $F^-$ ions such as fluoro-sulfuric acid and fluoro-nitric acid may be done. In this case, however, it is necessary to observe severe process control regarding the treating temperature and time, and water washing so as to prevent the coming of the acid pickling solution into the chromate treating bath.

Then the chromate treatment is performed under the following conditions, for example.

(a) $F^-$ ion-containing treating bath:

| | | |
|---|---|---|
| Bath composition: | $CrO_3$ | 85 g/l |
| | $SO_4^{2-}$ | 0.07 g/l |
| | $Na_2SiF_6$ | 2.7 g/l |
| | $NH_4F$ | 0.4 g/l |
| Current density: | 60 A/dm$^2$ | |
| Bath temperature: | 40° C. | |

(b) $SO_4^{-2}$ ion containing treating bath:

| | | |
|---|---|---|
| Bath composition: | $CrO_3$ | 100 g/l |
| | $SO_4^{2-}$ | 1.0 g/l |
| Current Density: | 60 A/dm$^2$ | |
| Bath temperature: | 60° C. | |

With the above chromate treatment, it is possible to obtain a chromate treatment film excellent in uniformity and adhesion which can assure the desired paint coating qualities. In this connection, it is noteworthy that the treatment in the $F^-$ ion containing bath is effective to remove the oxide film from the substrate surface during the treatment in the bath, as mentioned herein before, so that the uniformity of the resultant chromate qualities are further improved.

DETAILED DESCRIPTION OF THE PREFERRED EMBODIMENTS

The present invention will be better understood from the following description of preferred embodiments.

Steel sheets having various composition, particularly with respect to the chromium content, as shown in Table 1 were degreased in a degreasing bath composed of 3% NaOH aqueous solution with addition of 0.3% of surfactant, washed with water, and then subjected to a cathodic degreasing treatment in 10% $H_2SO_4$ aqueous solution at ordinary temperatures, a current density of 15A/dm$^2$, for 0.5 second, and washed with water. Then the resultant surface-cleaned and surface-activated steel sheets were subjected to a chromate treatment under the conditions shown in Table 2. The evaluation of the chromate treated steel sheets thus obtained was made by various tests conducted under the following conditions and the results are shown in Table 3.

As understood from the results, the steel substrates prepared according to the present invention are very excellent for use as paint coated steel sheets, as compared with the comparative steel sheets.

EVALUATION TEST METHODS (1) Surface Appearance after Application of Clear Lacquer Steel sheets applied with chromate film were coated with epoxy-phenol clear lacquer in a thickness of 2.5μ and the surface appearance was judged by eye observation.

⊙ . . . Whitish appearance with metallic brightness

○ . . . Whitish appearance with slightly less metallic brightness

X . . . Blackish appearance (2) Pitting Corrosion Resistance of Paint Coated Sheets with respect to Coating Defective Portion —Evaluation is made with respect to corrosion resistance after paint coating—

Steel substrates were applied with 5μ thick epoxy-phenol paint coating, and artificially scratched through the coating to the substrate surface, and then immersed in an aqueous solution (1.5% NaCl + 1.5% citric acid) at 27° C. for fifteen days. After the immersion, the depth of the pitting corrosion caused by the solution reaching the substrate surface through the coating was measured by a microscope to evaluate the after-coating corrosion resistance. The test pieces were prepared from 0.21 mm thick substrates.

⊙ . . . Depth pitting corrosion not more than 0.05 mm
○ . . . Depth pitting corrosion not more than 0.10 mm
Δ . . . Depth pitting corrosion not more than 0.15 mm
X . . . Overall pitting corrosion (3) Paint Adhesion after Lapse of Time (Secondary Paint Adhesion with respect to Coating Defective Portions)

Steel substrates were applied with 4.2μ thick epoxy-phenol paint containing Zn powder pigment, scratched in checks of 1 mm×1 mm penetrating through the coating to reach the substrate surface, immersed in an aqueous solution (1.5% NaCl+1.5% citric acid) at 55° C. for 96 hours, dried, and immediately subjected to vinyl tape peeling-off tests to evaluate the secondary paint adhesion from the peeling-off area.

⊙ . . . Peeling-off area not more than 5%
○ . . . Peeling-off area not more than 10%
Δ . . . Peeling-off area not more than 20%
X . . . More than 20% to overall peeling off (4) Evaluation of Paint Coating Qualities with respect to Worked Portion of Paint Coated Sheets Steel substrates of 0.25 mm in thickness were applied with 6.5μ thick epoxy-phenol paint coating containing Zn powder pigment, subjected to Erichsen extrusion to 3 mm depth, immersed in an aqueous solution (1.5% NaCl +1.0% citric acid 0.5% phosphoric acid) at 55° C. for 96 hours, dried and immediately subjected to vinyl tape peeling off tests to measure the peeling off areas, and coating qualities, especially paint coating adhesion along lapse of time after the working was evaluated on the basis of the paint coating peeling off areas.

⊙ . . . Paint coating peeling-off area not more than 5%
○ . . . Paint coating peeling-off area not more than 20%
Δ . . . Paint coating peeling-off area not more than 50%
X . . . Paint coating peeling off area more than 50% to overall peeling off (5) Corrosion Resistance Evaluated by Long-Term Corrosion Tests (A) Paint Coating Qualities after Long-Term Corrosion Test Using Paint for Building Steel substrates of 0.6 mm in thickness were applied with 5μ thick undercoating of epoxy paint, further applied with 13μ thick silicone-polyester paint, subjected to one T bending and a salt spray test for 1000 hours to observe the surface appearance, and further subjected to vinyl tape peeling-off tests to evaluate the paint coating qualities.

⊙ . . . Substantially no red rust formation and no coating pelling-off
○ . . . Not more than 5% red rust formation and coating peeling-off
Δ . . . Not more than 10% red rust formation or not more than 20% coating peeling-off
X . . . More than 10% red rust formation or more than 20% coating peeling-off (B) Corrosion Resistance Evaluated by Cyclic Corrosion Tests of Electro-Deposition Paint Coated Sheets Steel substrates were applied with 20μ thick paint coating by a cation electro-deposition method, scratched through the coating to the substrate surface and subjected to 125 cycles of cyclic corrosion tests as below: (1) salt spray test (5% NaCl, 35° C., 4 hours) →(2) drying (70° C., 60% humidity, 2 hours)→(3) wetting 49° C., 98% humidity, 2 hours)→(4) cooling (−20° C., 2 hours)→again to (1). One cycle comprises (1) to (4) and the cyclic corrosion test comprised 125 cycles. The corrosion resistance was evaluated by the following criteria.

⊙ . . . Not more than 0.3 mm depth of pitting corrosion and not more than 3.5 mm swelling width of the scratched coating on one side
○ . . . More than 0.3 mm to not more than more 0.40 mm depth of pitting corrosion and not more than 3.5 mm swelling of scratched coating on one side
Δ . . . More than 0.3 mm to not more than 0.40 mm depth of pitting corrosion and more than 3.5 mm to not more than 5 mm swelling width of scratched coating on one side
X . . . More than 0.40 mm depth of pitting corrosion and more than 5 mm swelling width of scratched coating on one side (6) Corrosion Resistance in Sheared Edges of Paint Coated Sheets Steel substrates of 0.22 mm in thickness were applied with 5.5μ thick epoxy-phenol paint, sheared by stamping, and the corrosion resistance of the sheared edges were relatively evaluated by the following methods and criteria.

(A) Red Rust Formation in Sheared Edges after 24 hours Salt Spray Tests

⊙ . . . Substantially no formation of red rust
○ . . . Red rust formation not more than 5%
Δ . . . Red rust formation not more than 10%
X . . . . Red rust formation more than 10%

(B) Red Rust Formation in Sheared Edges after Cyclic Wetting Tests

The tests were conducted by holding the test pieces in a humid tank at 49° C., not lower than 98% RH for one hour, dried and left at room temperatures for 2 hours. These test procedures constituting one cycle of test were repeated 10 times (10 cycles) and red rust formation in the sheared edges was evaluated by the following criteria.

⊙ . . . Substantially no red rust formation
○ . . . Red rust formation not more than 5%
Δ . . . Red rust formation not more than 10%
X . . . Red rust formation more than 10%

(7) Formability (A) Evaluation of Drawability 470 mm square blanks prepared from 1.0 mm thick chromate treated steel substrates according to the present invention and comparative steel substrates were drawn into angular cylinders forms using 200 mm square punch with 10 tons blank holding force. As the lubricant, #620 oil by Nippon Kosaku was used. The drawability was evaluated relatively on the basis of the limits of drawing depth, surface smoothness of the drawn products (such as occurrence of riggings) and surface damages such as caused by punch biting.

⊙ . . . Very excellent
○ . . . Relatively good
Δ . . . Relatively inferior
X . . . Very inferior (B) Evaluation of Secondary Workability Circular blanks of 133.2 mm in diameter prepared from 0.8 mm thick chromate treated steel substrates according to the present invention and comparative substrates were subjected to three-step drawing: first step of 2.22, second step of 2.89 and third step of 3.6, and pushed with a conical punch at −40° C. to see the occurrence of longitudinal cracking, on the basis of which the secondary workability was evaluated.

⊙ . . . No longitudinal cracking and good secondary workability

X . . . Longitudinal cracking occurrence and inferior secondary workability

Measurement Impossible: Cracking was caused by the three-step drawing so that the secondary workability could not evaluated (inferior workability).

(8) Evaluation of Strength (A) Dent Resistance 0.20 mm thick test pieces prepared from the chromate treated substrates according to the present invention and comparative substrates were subjected to 10% bulging, and a punch (12.7 mm diameter, and 8 mm R, 200 g) was dropped down from 30 cm height onto the bulged sheets. The dent resistance was evaluated from the surface damages such as dents according to the criteria set forth below.

⊙ . . . Very excellent

○ . . . Relatively good

Δ . . . Relatively inferior

X . . . Very inferior (B) Hardness Evaluation 0.25 mm thick steel sheets as tempered and chromate treated according to the present invention and comparative sheets were evaluated according to the criteria set forth below.

⊙ . . . Hardness not less than 68 (HRT 30)

○ . . . Hardness not less than 63 to less than 68 (HRT 30)

Δ . . . Hardness not less than 58 to less than 63 (HRT 30)

X . . . Hardness less than 58 (HRT 30)

As understood from the foregoing description and embodiments, the chromate surface treated steel substrates according to the present invention can advantageously be used as paint coated steel sheets in various fields including containers, automobile rust-proof sheets, and paint coated sheets for buildings (such as color stainless steel sheets).

TABLE 1

| | Steel Compositions (wt %) | | | | | | | | | | | | |
|---|---|---|---|---|---|---|---|---|---|---|---|---|---|
| | C | Si | Mn | P | S | SolAl | Cr | Ti | Nb | Zr | V | Ni | B |
| Example 1 | 0.10 | 0.06 | 0.16 | 0.011 | 0.012 | 0.08 | 3.1 | — | — | — | — | — | — |
| Example 2 | 0.08 | 0.07 | 0.18 | 0.010 | 0.014 | 0.05 | 5.3 | — | — | — | — | — | — |
| Example 3 | 0.05 | 0.08 | 0.15 | 0.013 | 0.008 | 0.03 | 7.8 | 0.09 | — | — | — | — | — |
| Example 4 | 0.11 | 0.010 | 0.12 | 0.011 | 0.011 | 0.04 | 10.5 | 0.08 | 0.05 | — | — | — | — |
| Example 5 | 0.06 | 0.005 | 0.18 | 0.013 | 0.014 | 0.06 | 17.5 | — | 0.18 | — | — | 8 | — |
| Example 6 | 0.12 | 0.007 | 0.15 | 0.013 | 0.012 | 0.05 | 5.5 | 0.14 | — | — | — | 0.5 | — |
| Example 7 | 0.07 | 0.04 | 0.13 | 0.013 | 0.016 | 0.04 | 9.5 | 0.05 | — | 0.01 | 0.02 | — | — |
| Comparison 1 | 0.04 | 0.05 | 0.16 | 0.015 | 0.012 | 0.03 | — | — | — | — | — | — | — |
| Comparison 2 | 0.06 | 0.06 | 0.12 | 0.014 | 0.017 | 0.07 | 0.005 | — | — | — | — | 0.01 | — |
| Comparison 3 | 0.10 | 0.07 | 0.18 | 0.010 | 0.014 | 0.05 | 5.3 | — | — | — | — | — | — |
| Comparison 4 | 0.06 | 0.04 | 0.13 | 0.013 | 0.016 | 0.04 | 19.1 | 0.05 | — | 0.01 | 0.02 | — | — |
| Comparison 5 | 0.08 | 0.010 | 0.12 | 0.011 | 0.011 | 0.04 | 16.4 | 0.08 | 0.05 | — | — | — | — |
| Comparison 6 | 0.004 | 0.010 | 0.12 | 0.013 | 0.019 | 0.06 | 3.8 | 0.05 | — | — | — | — | — |
| Example 8 | 0.12 | 0.06 | 0.16 | 0.011 | 0.012 | 0.08 | 3.1 | — | — | — | — | 0.5 | — |
| Example 9 | 0.008 | 0.07 | 0.18 | 0.010 | 0.014 | 0.05 | 5.3 | — | — | — | — | 0.28 | — |
| Example 10 | 0.004 | 0.08 | 0.15 | 0.013 | 0.008 | 0.03 | 7.8 | 0.09 | — | — | — | 2.1 | — |
| Example 11 | 0.005 | 0.010 | 0.12 | 0.011 | 0.011 | 0.04 | 10.6 | 0.08 | 0.05 | — | — | 3.6 | — |
| Example 12 | 0.003 | 0.005 | 0.18 | 0.013 | 0.014 | 0.06 | 17.5 | — | 0.18 | — | — | 8 | — |
| Example 13 | 0.002 | 0.007 | 0.15 | 0.013 | 0.012 | 0.05 | 5.5 | 0.14 | — | — | — | 1.0 | — |
| Example 14 | 0.004 | 0.04 | 0.13 | 0.013 | 0.016 | 0.04 | 12.4 | 0.05 | — | 0.01 | 0.02 | 5.3 | — |
| Comparison 7 | 0.008 | 0.07 | 0.18 | 0.010 | 0.014 | 0.05 | 5.3 | — | — | — | — | 0.28 | — |
| Comparison 8 | 0.004 | 0.04 | 0.13 | 0.013 | 0.016 | 0.04 | 12.4 | 0.05 | — | 0.01 | 0.02 | 5.3 | — |
| Comparison 9 | 0.005 | 0.010 | 0.12 | 0.011 | 0.011 | 0.04 | 16.4 | 0.08 | 0.05 | — | — | — | — |
| Comparison 10 | 0.12 | 0.06 | 0.16 | 0.011 | 0.012 | 0.08 | 3.1 | — | — | — | — | — | — |
| Example 15 | 0.008 | 0.06 | 0.16 | 0.011 | 0.012 | 0.08 | 3.1 | 0.12 | — | — | — | — | 0.0008 |
| Example 16 | 0.004 | 0.07 | 0.18 | 0.010 | 0.014 | 0.05 | 5.3 | 0.15 | — | — | — | — | 0.0006 |
| Example 17 | 0.003 | 0.08 | 0.15 | 0.013 | 0.008 | 0.03 | 7.8 | 0.09 | — | — | 0.03 | — | 0.0012 |
| Example 18 | 0.005 | 0.010 | 0.12 | 0.011 | 0.011 | 0.04 | 10.5 | 0.08 | 0.05 | — | — | — | 0.0015 |
| Example 19 | 0.008 | 0.005 | 0.18 | 0.013 | 0.014 | 0.06 | 17.5 | — | 0.18 | — | — | — | 0.0005 |
| Example 20 | 0.002 | 0.007 | 0.15 | 0.013 | 0.012 | 0.05 | 5.5 | 0.14 | — | — | — | — | 0.0007 |
| Example 21 | 0.004 | 0.04 | 0.13 | 0.013 | 0.016 | 0.04 | 9.5 | 0.05 | 0.02 | 0.01 | 0.02 | — | 0.0010 |
| Comparison 11 | 0.06 | 0.06 | 0.12 | 0.014 | 0.017 | 0.07 | 0.005 | — | — | — | — | — | — |
| Comparison 12 | 0.004 | 0.07 | 0.18 | 0.010 | 0.014 | 0.05 | 5.3 | — | — | — | — | — | — |
| Comparison 13 | 0.003 | 0.04 | 0.13 | 0.013 | 0.016 | 0.04 | 9.5 | 0.05 | — | 0.01 | 0.02 | — | 0.0008 |
| Comparison 14 | 0.008 | 0.010 | 0.12 | 0.011 | 0.011 | 0.04 | 16.4 | 0.08 | 0.05 | — | — | — | 0.0007 |
| Comparison 15 | 0.004 | 0.010 | 0.12 | 0.013 | 0.019 | 0.06 | 3.8 | 0.13 | — | — | — | — | — |
| Example 22 | 0.006 | 0.06 | 0.16 | 0.011 | 0.012 | 0.08 | 3.1 | 0.14 | — | — | — | 0.5 | 0.0011 |
| Example 23 | 0.008 | 0.07 | 0.18 | 0.010 | 0.014 | 0.05 | 5.3 | 0.08 | — | — | 0.03 | 0.28 | 0.0008 |
| Example 24 | 0.004 | 0.08 | 0.15 | 0.013 | 0.008 | 0.03 | 6.7 | 0.09 | — | — | — | 2.1 | 0.0006 |
| Example 25 | 0.005 | 0.010 | 0.12 | 0.011 | 0.011 | 0.04 | 8.5 | 0.08 | 0.05 | — | — | 3.6 | 0.0004 |
| Example 26 | 0.003 | 0.005 | 0.18 | 0.013 | 0.014 | 0.06 | 9.8 | — | 0.18 | — | — | 1.8 | 0.0016 |
| Example 27 | 0.002 | 0.007 | 0.15 | 0.013 | 0.012 | 0.05 | 13.2 | 0.14 | — | — | — | 1.0 | 0.0007 |
| Example 28 | 0.004 | 0.04 | 0.13 | 0.013 | 0.016 | 0.04 | 16.5 | 0.05 | — | 0.01 | 0.02 | 4.9 | 0.0003 |
| Comparison 16 | 0.008 | 0.07 | 0.18 | 0.010 | 0.014 | 0.05 | 5.3 | — | — | — | — | 0.28 | 0.0007 |
| Comparison 17 | 0.004 | 0.04 | 0.13 | 0.013 | 0.016 | 0.04 | 12.8 | 0.05 | — | 0.01 | 0.02 | 5.3 | 0.0009 |
| Comparison 18 | 0.005 | 0.010 | 0.12 | 0.011 | 0.011 | 0.04 | 16.4 | 0.08 | 0.05 | — | — | — | 0.0012 |
| Comparison 19 | 0.005 | 0.06 | 0.16 | 0.011 | 0.012 | 0.08 | 3.1 | — | — | — | — | — | — |

TABLE 2

| | Chromate Treatment Conditions and Resultant Chromate Film Structures | | | |
|---|---|---|---|---|
| | Chromate Treatment Conditions | | Film Structures | |
| Example 1 | Bath Composition | $CrO_3$ 100 g/l, $SO_4^{2-}$ 1 g/l | Metallic Cr Layer | 100 mg/m$^2$ |
| | Bath Temperature | 60° C. | Cr Oxide Layer | 23 mg/m$^2$ |
| | Electrolysing Condition | 60A/dm$^2$ – 1.0 sec | | |
| Example 2 | Bath Composition | $CrO_3$ 85 g/l, $SO_4^{2-}$ 0.07 g/l, $Na_2SiF_4$ 2.7 g/l, $NH_4F$ 0.4 g/l | Metallic Cr Layer | 45 mg/m$^2$ |
| | Bath Temperature | 60° C. | Cr Oxide Layer | 11 mg/m$^2$ |
| | Electrolysing Condition | 60 A/dm$^2$ –0.5 sec | | |
| Example 3 | Bath Composition | $CrO_3$ 85 g/l, $SO_4^{2-}$ 0.07 g/l, $Na_2SiF_4$ 2.7 g/l, $NH_4F$ 0.4 g/l | Metallic Cr Layer | 10 mg/m$^2$ |
| | Bath Temperature | 50° C. | Cr Oxide Layer | 8 mg/m$^2$ |
| | Electrolysing Condition | 60 A/dm$^2$ 0.1 sec | | |
| Example 4 | Bath Composition | $CrO_3$ 85 g/l, $SO_4^{2-}$ 0.07 g/l, $Na_2SiF_4$ 2.7 g/l, $NH_4F$ 0.2 g/l | Metallic Cr Layer | 58 mg/m$^2$ |
| | Bath Temperature | 40° C. | Cr Oxide Layer | 25 mg/m$^2$ |
| | Electrolysing Condition | 60 A/dm$^2$ –0.5 sec | | |
| Example 5 | Bath Composition | $CrO_3$ 100 g/l, $SO_4^{2-}$ 0.7 g/l | Metallic Cr Layer | 25 mg/m$^2$ |
| | Bath Temperature | 40° C. | Cr Oxide Layer | 12 mg/m$^2$ |
| | Electrolysing Condition | 5 A/dm$^2$ 1.0 sec | | |
| Example 6 | Bath Composition | $CrO_3$ 85 g/l, $SO_4^{2-}$ 0.07 g/l, $Na_2SiF_4$ 2.7 g/l, $NH_4F$ 0.4 g/l | Metallic Cr Layer | 6.5 mg/m$^2$ |
| | Bath Temperature | 50° C. | Cr Oxide Layer | 9.1 mg/m$^2$ |
| | Electrolysing Condition | 15 A/dm$^2$ –1.0 sec | | |
| Example 7 | Bath Composition | $CrO_3$ 85 g/l, $SO_4^{2-}$ 0.07 g/l, $Na_2SiF_4$ 2.7 g/l, $NH_4F$ 0.4 g/l | Metallic Cr Layer | 18 mg/m$^2$ |
| | Bath Temperature | 40° C. | Cr Oxide Layer | 15 mg/m$^2$ |
| | Electrolysing Condition | 20 A/dm$^2$ | | |
| Comparison 1 | Same as Example 1 | | Metallic Cr Layer | 108 mg/m$^2$ |
| | | | Cr Oxide Layer | 25 mg/m$^2$ |
| Comparison 2 | Same as Example 2 | | Metallic Cr Layer | 50 mg/m$^2$ |
| | | | Cr Oxide Layer | 13 mg/m$^2$ |
| Comparison 3 | Same as Example 2 | | Metallic Cr Layer | 50 mg/m$^2$ |
| | | | Cr Oxide Layer | 13 mg/m$^2$ |
| Comparison 4 | Same as Example 2 | | Metallic Cr Layer | 50 mg/m$^2$ |
| | | | Cr Oxide Layer | 13 mg/m$^2$ |
| Comparison 5 | The same bath as in Example 4 was used but the electrolying condition and bath temperature were changed to deposit more chromium oxide. | | Metallic Cr Layer | 58 mg/m$^2$ |
| | | | Cr Oxide Layer | 62 mg/m$^2$ |
| Comparison 6 | Same as Example 2 | | Metallic Cr Layer | 47 mg/m$^2$ |
| | | | Cr Oxide Layer | 12 mg/m$^2$ |

TABLE 2-B

| | Chromate Treatment Conditions and Resultant Chromate Film Structures | | | |
|---|---|---|---|---|
| | Chromate Treatment Conditions | | Film Structures | |
| Example 8 | Bath Composition | $CrO_3$ 100 g/l, $SO_4^{2-}$ 1g/l | Metallic Cr Layer | 100 mg/m$^2$ |
| | Bath Temperature | 60° C | Cr Oxide Layer | 23 mg/m$^2$ |
| | Electrolysing Condition | 60A/dm$^2$— 1.0 sec | | |
| Example 9 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 45 mg/m$^2$ |
| | Bath Temperature | 60°C | Cr Oxide Layer | 11 mg/m$^2$ |
| | Electrolysing Condition | 60A/dm$^2$— 0.5 sec | | |
| Example 10 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 10 mg/m$^2$ |
| | Bath Temperature | 50°C | Cr Oxide Layer | 8 mg/m$^2$ |
| | Electrolysing Condition | 60A/dm$^2$— 0.1 sec | | |
| Example 11 | Bath Composition | $CrO_3$ 85 g/l, $SO_4^{2-}$ 0.07 g/l, $Na_2SiF_6$ 2.7 g/l, $NH_4F$ 0.2 g/l | Metallic Cr Layer | 58 mg/m$^2$ |
| | Bath Temperature | 40°C | Cr Oxide Layer | 25 mg/m$^2$ |
| | Electrolysing Condition | 60A/dm$^2$— 0.5 sec | | |
| Example 12 | Bath Composition | $CrO_3$ 100 g/l, $SO_4^{2-}$ 0.07 g/l | Metallic Cr Layer | 25 mg/m$^2$ |
| | Bath Temperature | 40°C | Cr Oxide Layer | 12 mg/m$^2$ |
| | Electrolysing Condition | 5A/dm$^2$— 1.0 sec | | |
| Example 13 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 6.5 mg/m$^2$ |
| | Bath Temperature | 50°C | Cr Oxide Layer | 9.1 mg/m$^2$ |
| | Electrolysing Condition | 15A/dm$^2$— 1.0 sec | | |
| Example 14 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 18 mg/m$^2$ |
| | Bath Temperature | 40°C | Cr Oxide Layer | 15 mg/m$^2$ |
| | Electrolysing Condition | 20A/dm$^2$ | | |
| Comparison 7 | ——— | | ——— | |
| Comparison 8 | ——— | | ——— | |
| Comparison 9 | The same bath as in Example 11 was used but the electrolysing condition and bath temperature were changed to deposit more chromium oxide. | | Metallic Cr Layer | 58 mg/m$^2$ |
| | | | Cr Oxide Layer | 62 mg/m$^2$ |
| Comparison 10 | Same as Example 8 | | Metallic Cr Layer | 100 mg/m$^2$ |
| | | | Cr Oxide Layer | 22 mg/m$^2$ |

TABLE 2-C

| | Chromate Treatment Conditions and Resultant Chromate Film Structures | | | |
|---|---|---|---|---|
| | | Chromate Treatment Conditions | Film Structures | |
| Example 15 | Bath Composition | $CrO_3$ 100 g/l $SO_4^{2-}$ 1g/l | Metallic Cr Layer | 100 mg/m$^2$ |
| | Bath Temperature | 60° C | Cr Oxide Layer | 23 mg/m$^2$ |
| | Electrolysing Condition | 60A/dm$^2$— 1.0 sec | | |
| Example 16 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 45 mg/m$^2$ |
| | Bath Temperature | 60°C | Cr Oxide Layer | 11 mg/m$^2$ |
| | Electrolysing Condition | 60A/dm$^2$— 0.5 sec | | |
| Example 17 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 10 mg/m$^2$ |
| | Bath Temperature | 50°C | Cr Oxide Layer | 8 mg/m$^2$ |
| | Electrolysing Condition | 60A/dm$^2$— 0.1 sec | | |
| Example 18 | Bath Composition | $CrO_3$ 85 g/l, $SO_4^{2-}$ 0.07 g/l, $Na_2SiF_6$ 2.7 g/l, $NH_4F$ 0.2 g/l | Metallic Cr Layer | 58 mg/m$^2$ |
| | Bath Temperature | 40°C | Cr Oxide Layer | 25 mg/m$^2$ |
| | Electrolysing Condition | 60A/dm$^2$— 0.5 sec | | |
| Example 19 | Bath Composition | $CrO_3$ 100 g/l, $SO_4^{2-}$ 0.07 g/l | Metallic Cr Layer | 25 mg/m$^2$ |
| | Bath Temperature | 40°C | Cr Oxide Layer | 12 mg/m$^2$ |
| | Electrolysing Condition | 5A/dm$^2$— 1.0 sec | | |
| Example 20 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 6.5 mg/m$^2$ |
| | Bath Temperature | 50°C | Cr Oxide Layer | 9.1 mg/m$^2$ |
| | Electrolysing Condition | 15A/dm$^2$— 1.0 sec | | |
| Example 21 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 18 mg/m$^2$ |
| | Bath Temperature | 40°C | Cr Oxide Layer | 15 mg/m$^2$ |
| | Electrolysing Condition | 20A/dm$^2$ | | |
| Comparison 11 | | Same as Example 16 | Metallic Cr Layer | 50 mg/m$^2$ |
| | | | Cr Oxide Layer | 13 mg/m$^2$ |
| Comparison 12 | | ——— | ——— | |
| Comparison 13 | | ——— | ——— | |
| Comparison 14 | | The same bath as in Example 18 was used but the electrolysing condition and bath temperature were changed to deposit more chromium oxide. | Metallic Cr Layer | 58 mg/m$^2$ |
| | | | Cr Oxide Layer | 62 mg/m$^2$ |
| Comparison 15 | | Same as Example 16 | Metallic Cr Layer | 47 mg/m$^2$ |
| | | | Cr Oxide Layer | 12 mg/m$^2$ |

TABLE 2-D

| | Chromate Treatment Conditions and Resultant Chromate Film Structures | | | |
|---|---|---|---|---|
| | | Chromate Treatment Conditions | Film Structures | |
| Example 22 | Bath Composition | $CrO_3$ 100 g/l $SO_4^{2-}$ 1g/l | Metallic Cr Layer | 100 mg/m$^2$ |
| | Bath Temperature | 60° C | Cr Oxide Layer | 23 mg/m$^2$ |
| | Electrolysing Condition | 60A/dm$^2$— 1.0 sec | | |
| Example 23 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 45 mg/m$^2$ |
| | Bath Temperature | 60°C | Cr Oxide Layer | 11 mg/m$^2$ |
| | Electrolysing Condition | 60A/dm$^2$— 0.5 sec | | |
| Example 24 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 10 mg/m$^2$ |
| | Bath Temperature | 50°C | Cr Oxide Layer | 8 mg/m$^2$ |
| | Electrolysing Condition | 60A/dm$^2$— 0.1 sec | | |
| Example 25 | Bath Composition | $CrO_3$ 85 g/l, $SO_4^{2-}$ 0.07 g/l, $Na_2SiF_6$ 2.7 g/l, $NH_4F$ 0.2 g/l | Metallic Cr Layer | 58 mg/m$^2$ |
| | Bath Temperature | 40°C | Cr Oxide Layer | 25 mg/m$^2$ |
| | Electrolysing Condition | 60A/dm$^2$— 0.5 sec | | |
| Example 26 | Bath Composition | $CrO_3$ 100 g/l, $SO_4^{2-}$ 0.07 g/l | Metallic Cr Layer | 25 mg/m$^2$ |
| | Bath Temperature | 40°C | Cr Oxide Layer | 12 mg/m$^2$ |
| | Electrolysing Condition | 5A/dm$^2$— 1.0 sec | | |
| Example 27 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 6.5 mg/m$^2$ |
| | Bath Temperature | 50°C | Cr Oxide Layer | 9.1 mg/m$^2$ |
| | Electrolysing Condition | 15A/dm$^2$— 1.0 sec | | |
| Example 28 | Bath Composition | $CrO_3$ 85 g/l, $SO_4^{2-}$ 0.07 g/l, $Na_2SiF_6$ 2.7 g/l, $NH_4F$ 0.4 g/l | Metallic Cr Layer | 18 mg/m$^2$ |
| | Bath Temperature | 40°C | Cr Oxide Layer | 15 mg/m$^2$ |
| | Electrolysing Condition | 20A/dm$^2$ | | |
| Comparison 16 | | ——— | ——— | |
| Comparison 17 | | ——— | ——— | |
| Comparison 18 | | The same bath as in Example 25 was used but the electrolysing condition and bath temperature were changed to deposit more chromium oxide. | Metallic Cr Layer | 58 mg/m$^2$ |
| | | | Cr Oxide Layer | 62 mg/m$^2$ |
| Comparison 19 | | Same as Example 22 | Metallic Cr Layer | 100 mg/m$^2$ |
| | | | Cr Oxide Layer | 22 mg/m$^2$ |

TABLE 3

| | 1. Surface Appearance after Clear Lacquer Coating | 2. Pitting Corrosion Resistance in Coating Defective Portions | 3. Paint Coating Adhesion on Coating Defective Portions | 4. Coating Quality in Worked Portions of Paint Coated Sheet | 5. Corrosion Resistance after Long-Term Corrosion Test of Paint Coated Sheet | |
|---|---|---|---|---|---|---|
| | | | | | A. SST Evaluation of Sheets Coated with Paint for Building Materials | B. CCT Evaluation of Electro-Deposition Paint Coated Sheets |
| Example 1 | ○ | ○ | ○ | ○ | ○ | ○ |
| Example 2 | ◎ | ◎ | ◉ | ◎ | ○ | ○ |
| Example 3 | ◎ | ◎ | ◎ | ◎ | ◎ | ◉ |
| Example 4 | ◎ | ◎ | ◉ | ◎ | ◉ | ◎ |
| Example 5 | ◎ | ◎ | ◉~Δ | ○~Δ | ◉ | ◉ |
| Example 6 | ◎ | ◎ | ◉ | ◎ | ○ | ○ |
| Example 7 | ◎ | ◎ | ◉ | ◎ | ◉ | ◉ |
| Example 8 | ◎ | ◎~○ | ◉~○ | ◎ | ◉~○ | ◉~○ |
| Example 9 | ◎ | ◎ | ◉ | ◎ | ◉~○ | ◎~○ |
| Example 10 | ◎ | ◉ | ◉ | ◎ | ◉ | ◉ |
| Example 11 | ◎ | ◎ | ◎ | ◎ | ◉ | ◉ |
| Example 12 | ◎ | ◎ | ◉~Δ | ○ | ◉ | ◎ |
| Example 13 | ◎ | ◎ | ◉ | ◎ | ◎ | ◉ |
| Example 14 | ◎ | ◎ | ◉ | ◎ | ◉ | ◉ |
| Example 15 | ○ | ○ | ○ | ○ | ○ | ○ |
| Example 16 | ◎ | ◎ | ◉ | ◎ | ◉ | ◉ |
| Example 17 | ◎ | ◎ | ◎ | ◎ | ◎ | ◎ |
| Example 18 | ◎ | ◎ | ◉ | ◎ | ◎ | ◎ |
| Example 19 | ◎ | ◉ | ◉~Δ | ○~Δ | ○~Δ | ◉ |
| Example 20 | ◎ | ◎ | ◉ | ◉ | ◎ | ◉ |
| Example 21 | ◎ | ◎ | ◎ | ◎ | ◎ | ◉ |
| Example 22 | ◉ | ◎~○ | ◎~○ | ◉ | ◎~○ | ◎~○ |
| Example 23 | ◎ | ◎ | ◎ | ◎ | ◎ | ◎ |
| Example 24 | ◎ | ◎ | ◎ | ◎ | ◎ | ◎ |
| Example 25 | ◉ | ◎ | ◎ | ◎ | ◎ | ◉ |
| Example 26 | ◎ | ◎ | ◎~Δ | ○ | ○~Δ | ◎ |
| Example 27 | ◎ | ◎ | ◉ | ◉ | ◉ | ◎ |
| Example 28 | ◉ | ◎ | ◎ | ◎ | ◎ | ◎ |
| Comparison 1 | x | x | Δ | x | x | x |
| Comparison 2 | x | x | Δ | x | x | x |
| Comparison 3 | ◉ | ◎ | x | x | x | x |
| Comparison 4 | ◉ | ◎ | x | x | Δ~x | Δ~x |
| Comparison 5 | ◉ | ◎ | x | x | Δ~x | Δ~x |
| Comparison 6 | ◎ | ◎ | ◎ | ◎ | ◉ | ◎ |
| Comparison 7 | ◎ | ◎ | x | x | x | x |
| Comparison 8 | ◎ | ◎ | x | x | x | x |
| Comparison 9 | ○ | ◎ | x | x | ◎ | ◎ |
| Comparison 10 | ○ | ○ | ○ | ○ | Δ | Δ |
| Comparison 11 | x | x | Δ | x | x | x |
| Comparison 12 | ◉ | ◎ | x | x | x | x |
| Comparison 13 | ◎ | ◎ | x | x | x | x |
| Comparison 14 | ◎ | ◎ | x | x | x | ◎ |
| Comparison 15 | ◉ | ◎ | ◉ | ◎ | ○ | ○ |
| Comparison 16 | ◎ | ◉ | x | x | x | x |
| Comparison 17 | ◉ | ◎ | x | x | x | x |
| Comparison 18 | ◎ | ◉ | x | x | x | ◎ |
| Comparison 19 | ○ | ○ | ◎ | ○ | ○ | ○ |

TABLE 3-continued

| | 6. Corrosion Resistance in Sheared Edges of Paint Coated Sheets | | 7. Formability | | 8. Strength | |
|---|---|---|---|---|---|---|
| | A. SST Evaluation | B. Wet Cycle Test Evaluation | A. Drawability | B. Secondary Workability | A. Dent Resistance | B. Hardness |
| Example 1 | ○ | ○ | ○~△ | x | ◎ | ○ |
| Example 2 | ◎ | ◎ | ○~△ | x | ◎ | ◎ |
| Example 3 | ◎ | ◎ | x | x | ◎ | ◎ |
| Example 4 | ◎ | ◎ | x | x | ◎ | ◎ |
| Example 5 | ◎ | ◎ | x | x | ◎ | ◎ |
| Example 6 | ◎ | ◎ | x | x | ◎ | ◎ |
| Example 7 | ◎ | ◎ | x | x | ◎ | ○ |
| Example 8 | ◎~○ | ◎~○ | ○ | x | △ | △ |
| Example 9 | ◎ | ◎ | ○~△ | △ | x | x |
| Example 10 | ◎ | ◎ | ◎ | ◎ | x | x |
| Example 11 | ◎ | ◎ | ◎ | △ | x | x |
| Example 12 | ◎ | ◎ | ◎ | ◎ | x | x |
| Example 13 | ◎ | ◎ | ◎ | ◎ | x | x |
| Example 14 | ◎ | ◎ | ◎ | ◎ | x | x |
| Example 15 | ○ | ○ | ◎ | ◎ | x | x |
| Example 16 | ◎ | ◎ | ◎ | ◎ | x | x |
| Example 17 | ◎ | ◎ | ◎ | ◎ | x | x |
| Example 18 | ◎ | ◎ | ◎ | ○ | x | x |
| Example 19 | ◎ | ◎ | ○ | ◎ | x | x |
| Example 20 | ◎ | ◎ | ◎ | ◎ | x | x |
| Example 21 | ◎ | ◎ | ◎ | ◎ | x | x |
| Example 22 | ◎~○ | ◎~○ | ◎ | ◎ | x | x |
| Example 23 | ◎ | ◎ | ◎ | ◎ | x | x |
| Example 24 | ◎ | ◎ | ◎ | ◎ | x | x |
| Example 25 | ◎ | ◎ | ◎ | ◎ | x | x |
| Example 26 | ◎ | ◎ | ○ | ◎ | x | x |
| Example 27 | ◎ | ◎ | ◎ | ◎ | x | x |
| Example 28 | ◎ | ◎ | ◎ | ◎ | x | x |
| Comparison 1 | x | x | ○ | unmeasurable | △ | △ |
| Comparison 2 | x | x | ○ | unmeasurable | △ | △ |
| Comparison 3 | ◎ | ◎ | ○~△ | x | ◎ | ◎ |
| Comparison 4 | ◎ | ◎ | x | x | ◎ | ◎ |
| Comparison 5 | ◎ | ◎ | x | x | ◎ | ◎ |
| Comparison 6 | ◎ | ◎ | ◎ | ◎ | x | x |
| Comparison 7 | ◎ | ◎ | ○ | ◎ | x | x |
| Comparison 8 | ◎ | ◎ | ◎ | ◎ | x | x |
| Comparison 9 | ◎ | ◎ | ◎ | x | x | x |
| Comparison 10 | ○ | ○ | ○~△ | x | ◎ | ◎ |
| Comparison 11 | x | x | ○ | unmeasurable | △ | △ |
| Comparison 12 | ◎ | ◎ | ◎ | x | x | x |
| Comparison 13 | ◎ | ◎ | ◎ | ◎ | x | x |
| Comparison 14 | ◎ | ◎ | x | x | ◎ | ○ |
| Comparison 15 | ○ | ○ | ◎ | x | x | x |
| Comparison 16 | ◎ | ◎ | ◎ | ◎ | x | x |
| Comparison 17 | ◎ | ◎ | ◎ | ◎ | x | x |
| Comparison 18 | ◎ | ◎ | x | ◎ | x | x |
| Comparison 19 | ○ | ○ | ◎ | x | x | x |

What is claimed is:

1. A chromate surface-treated steel sheet, excellent in paintability, corrosion resistance and workability comprising a chromium-containing steel substrate containing not more than 0.15% carbon, 0.005 to 0.10% acid soluble aluminium, 0.5 to 20% chromium with the balance being iron and unavoidable impurities, and a chromate coating applied on said steel substrate, said coating comprising a metallic chromium layer in an amount ranging from 1 to 300 mg/m$^2$, and a hydrated chromium oxide layer in an amount ranging from 5 to 50 mg/m$^2$ in term of the metallic chromium contained therein.

2. A steel sheet according to claim 1, wherein said steel substrate contains not more than 0.02% carbon.

3. A steel sheet according to claim 1, wherein said steel substrate further contains 0.1 to 10% nickel.

4. A steel sheet according to claim 1, wherein said steel substrate contains not more than 0.02% carbon and 0.1 to 10% nickel.

5. A steel sheet according to claim 1, wherein said steel substrate further contains not more than 0.0030% boron.

6. A steel sheet according to claim 5, wherein said steel substrate further contains 0.1 to 10% nickel.

7. A steel according to claim 1, wherein said steel substrate further contains at least one member selected from the group consisting of Ti, Nb, Zr, and V in an amount ranging from 0.03 to 0.5%.

8. A steel sheet according to claim 7, wherein said steel substrate contains not more than 0.02% carbon and 0.1 to 10% nickel.

* * * * *